US009691409B2

(12) United States Patent
Shin

(10) Patent No.: US 9,691,409 B2
(45) Date of Patent: Jun. 27, 2017

(54) EARSET AND CONTROL METHOD FOR THE SAME

(71) Applicant: Haebora Co., Ltd., Seoul (KR)

(72) Inventor: Doo Sik Shin, Seoul (KR)

(73) Assignee: Haebora Co., Ltd., Seoul (KR)

( * ) Notice: Subject to any disclaimer, the term of this patent is extended or adjusted under 35 U.S.C. 154(b) by 8 days.

(21) Appl. No.: 14/837,121

(22) Filed: Aug. 27, 2015

(65) Prior Publication Data

US 2016/0078881 A1 Mar. 17, 2016

(30) Foreign Application Priority Data

Sep. 17, 2014 (KR) ..... 10-2014-0123593

(51) Int. Cl.
*G10L 21/038* (2013.01)
*H04R 1/10* (2006.01)
*H04R 3/04* (2006.01)

(52) U.S. Cl.
CPC ..... *G10L 21/038* (2013.01); *H04R 1/1091* (2013.01); *H04R 3/04* (2013.01)

(58) Field of Classification Search
CPC ..... G10L 21/038; H04R 1/1091; H04R 3/04
See application file for complete search history.

(56) References Cited

U.S. PATENT DOCUMENTS 6,415,034 B1 * 7/2002 Hietanen ..... G10K 11/1788 381/151
7,773,759 B2 * 8/2010 Alves ..... G10L 21/02 379/406.01

FOREIGN PATENT DOCUMENTS

JP 2002125298 A * 4/2002
JP 2009267877 A * 11/2009
KR 101348505 B1 * 1/2014

* cited by examiner

*Primary Examiner* — Brenda Bernardi
(74) *Attorney, Agent, or Firm* — Hammer & Associates, P.C.

(57) ABSTRACT

Disclosed are an earset that may correct a frequency band of a voice coming from a user's ears into a frequency band of a voice coming from the user's mouth, and a control method for the same.

According to an embodiment, the control method for the earset including a first earphone unit that is inserted into ears of a user while including a first microphone and a first speaker, and a main body in which a second microphone is disposed, the control method includes: determining whether a voice correction function is activated; and correcting a frequency band of a voice input to the first microphone into a frequency band of a voice input to the second microphone, when the voice correction function is activated.

10 Claims, 8 Drawing Sheets

EARSET AND CONTROL METHOD FOR THE SAME

CROSS-REFERENCE TO RELATED APPLICATION

This application claims priority to and the benefit of Korean Patent Application No. 2014-0123593, filed on Sep. 17, 2014, the disclosure of which is incorporated herein by reference in its entirety.

BACKGROUND

1. Field of the Invention

The present invention relates to an earset and a control method for the same, and more particularly, to an earset that corrects a frequency band of a voice coming from a user's ears and outputs the corrected frequency band, and a control method for the same.

2. Discussion of Related Art

With an increase in the use of a mobile phone, the use of an earset is increasing. The earset refers to a device in which a microphone and a speaker are mounted, and a user's hands become free when using the earset so that the user can do other works even during a call.

However, the conventional earset has a structure in which only the speaker is located inside the user's ears and the microphone is arranged outside the ears. Thus, a howling phenomenon in which surrounding noise is input to the microphone during a call and output to the speaker again may occur. This is a cause of degrading the communication quality.

In order to overcome this problem, an earset including an in-the-ear type microphone in which both the speaker and the microphone are arranged inside the ears so that the corresponding call is proceeded only using the sound coming from the user's ears and blocking the sound outside the ears has been developed.

However, this earset has also a problem that the surrounding noise flows into the microphone to cause an echo phenomenon or a howling phenomenon, or the sound quality is degraded due to the interference or vibration noise caused by the speaker and the microphone.

In particular, a voice coming from the user's ears, that is, a voice coming through an auditory tube has a different frequency band and a different tone, when compared with a voice coming from the user's mouse, and thereby may cause a phenomenon in which the voice is howled while being dull, or create a nasal voice, whereby the voice transmission is not clear.

PRIOR ART DOCUMENT

Patent Document

Korean Patent Registration No. 10-1092958 (Title of the invention: earset, registration date: Dec. 6, 2011)

SUMMARY OF THE INVENTION

The present invention is directed to an earset which may correct a frequency band of a voice coming from a user's ears into a frequency band of a voice coming from the user's mouth, and a control method for the same.

According to an aspect of the present invention, there is provided a control method for an earset including a first earphone unit that is inserted into ears of a user while including a first microphone and a first speaker, and a main body in which a second microphone is disposed, the control method including: determining whether a voice correction function is activated; and correcting a frequency band of a voice input to the first microphone into a frequency band of a voice input to the second microphone when the voice correction function is activated.

Here, when the voice correction function is inactivated, the control method may further include: transmitting, to an external device, a first voice signal acquired by processing the voice input to the first microphone and a second voice signal acquired by processing the voice input to the second microphone.

Also, the control method may further include: detecting information about a frequency band of the second voice signal from the external device, and correcting a frequency band of the first voice signal based on the detected information about the frequency band.

Also, the correcting of the frequency band of the voice may be performed in a control unit provided in the main body.

Also, the second microphone may be inactivated after a voice coming from a mouth of the user is input.

According to another aspect of the present invention, there is provided a control method for an earset including a first earphone unit that is inserted into ears of a user while including a first microphone and a first speaker, and a main body that is connected to the first earphone unit, the control method including: inputting a voice coming from the inside of ears of the user to the first microphone; determining a voice gender of the voice input to the first microphone; and correcting a frequency band of the voice input to the first microphone into a reference frequency band that is a frequency band of a voice coming from a mouth of the user, based on the determination result.

According to still another aspect of the present invention, there is provided an earset system including: an earset that includes a first earphone unit inserted into ears of a user while including a first microphone and a first speaker, and a main body connected to the first earphone unit; and a control unit that corrects, when a voice coming from the ears of the user is input to the first microphone, a frequency band of the voice input to the first microphone into a reference frequency band that is a frequency band of a voice coming from a mouth of the user, based on a result obtained by determining a voice gender of the voice input to the first microphone.

Here, a second microphone for receiving an input of the voice coming from the mouth of the user may be disposed in the main body, and the control unit may detect information about the reference frequency band from a voice input to the second microphone.

Also, the control unit may be disposed in the main body.

Also, the control unit may be disposed in an external device capable of communicating with the main body.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
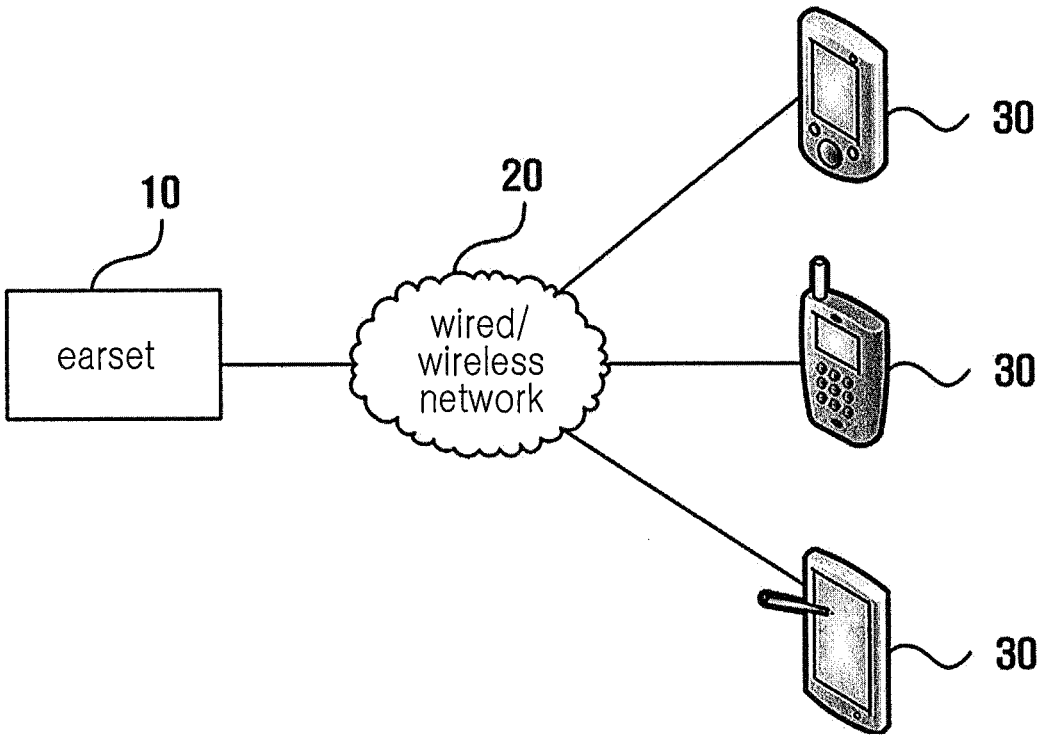
FIG. 1 illustrates a configuration of an earset system according to an embodiment of the present invention.

Hereinafter, exemplary embodiments of the present invention will be described in detail. However, the present invention is not limited to the exemplary embodiments disclosed below, but can be implemented in various forms. The following exemplary embodiments are described in order to enable those of ordinary skill in the art to embody and practice the invention. The scope of the present invention will be defined by the claims.

When it is determined that the detailed description of known art related to the present invention may obscure the gist of the present invention, the detailed description thereof will be omitted. The same reference numerals are used to refer to the same element throughout the specification. Terminology described below is defined considering functions in the present invention and may vary according to a user's or operator's intention or usual practice. Thus, the meanings of the terminology should be interpreted based on the overall context of the present specification.

The terminology used herein is for the purpose of describing particular embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, embodiments of the present invention will be described with reference to the accompanying drawings. The same reference numbers will be used throughout the drawings to refer to the same or like parts.

FIG. 1 illustrates a configuration of an earset system according to an embodiment of the present invention.

Referring to FIG. 1, an earset system 1 may include an earset 10 and an external device 30.

The earset 10 is a device that is inserted into a user's ears. The earset 10 may convert a voice coming from the user's ears into a voice signal, and transmit the voice signal to the external device 30 through a wired/wireless network 20. In addition, the earset 10 may receive an acoustic signal or a voice signal from the external device 30 through the wired/wireless network 20. Detailed description of the configuration of the earset 10 will be made below with reference to FIGS. 2 to 6.

The external device 30 transmits the acoustic signal or the voice signal to the earset 10 through the wired/wireless network 20, and receives the voice signal from the earset 10. According to an embodiment, the external device 30 may receive a voice signal of which a frequency band is corrected from the earset 10. According to another embodiment, the external device 30 receives a voice signal of a first microphone 112 and a voice signal of a second microphone 140 from the earset 10, detects information about a frequency band of the voice signal, and corrects the frequency band of the voice signal of the first microphone 112 into the detected frequency band. Here, the first microphone 112 may be mounted in the user's ears to receive an input of the voice signal transmitted from the ears, and the second microphone 140 may be mounted in the outside to receive an input of the voice signal transmitted from the user's mouth.

When the external device 30 transmits and receives signals through the wireless network, one wireless communication scheme among Ultrawideband, Zigbee, Wi-Fi, and Bluetooth may be used between the external device 30 and the earset 10.

When the external device 30 communicates with the earset 10 according to the wireless communication scheme, a pairing process between the external device 30 and the earset 10 may be performed in advance. The pairing process refers to a process of registering device information of the earset 10 in the external device 30 and registers device information of the external device 30 in the earset 10. When signals are transmitted and received in a state in which the pairing process has been completed, it is possible to maintain the security of the transmitted and received signals.

The external device 30 may include a wired/wireless communication device. As examples of the wired/wireless communication device, a palm PC (personal computer), a PDA (personal digital assistant), a WAP phone (wireless application protocol phone), a smart phone, a mobile terminal such as a smart pad or a mobile play-station, and the like may be given. The external device 30 as illustrated may be a wearable device that can be worn on a body part of a user, for example, the head, wrist, finger, arm, or waist. Although not illustrated, the external device 30 may be connected to the earset 10 in a wired manner.

Figure 2:
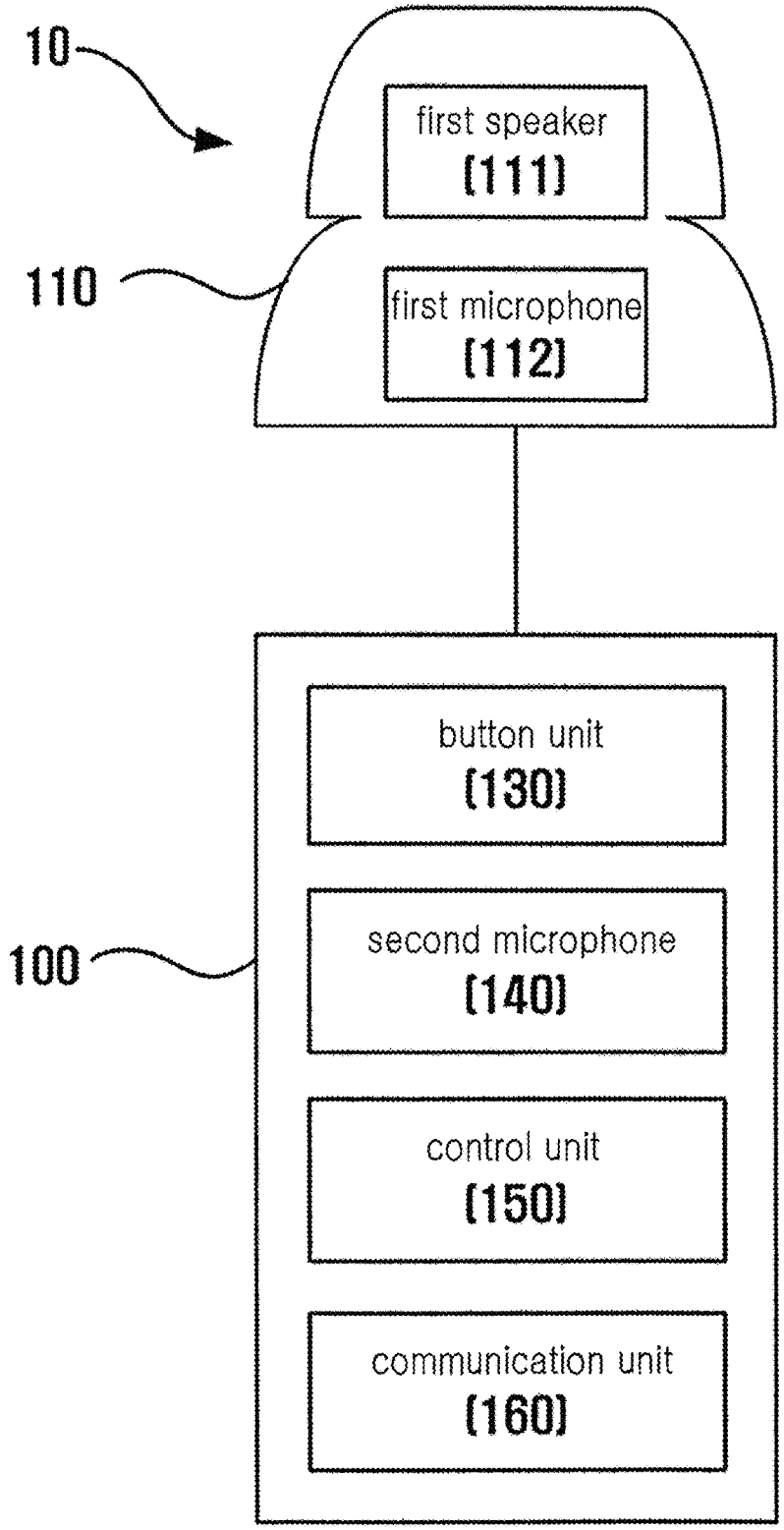
FIG. 2 illustrates a configuration of an earset according to an embodiment of the present invention.
Figure 3:
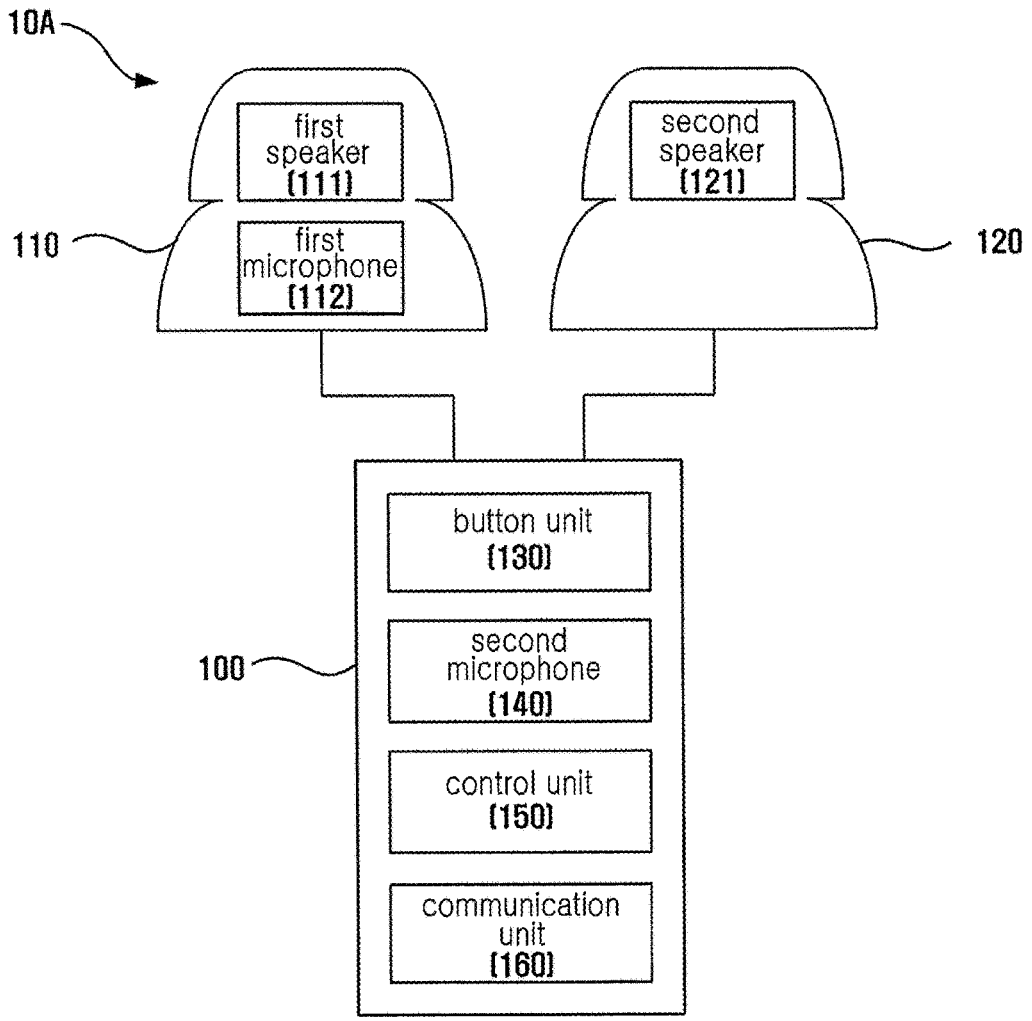
FIG. 3 illustrates a configuration of an earset according to another embodiment of the present invention.

FIG. 2 illustrates a configuration of the earset 10 according to an embodiment of the present invention, and FIG. 3 illustrates a configuration of the earset 10 according to another embodiment of the present invention.

First, referring to FIG. 2, the earset 10 according to an embodiment of the present invention includes a first earphone unit 110 and a main body 100.

The first earphone unit 110 includes a first speaker 111 and the first microphone 112, and is inserted into a user's first ear canal (an ear canal of the left ear) or the user's second ear canal (an ear canal of the right ear). The first earphone unit 110 may have a shape corresponding to the shape of the first ear canal or the shape of the second ear canal. Alternatively, the first earphone unit 110 may have a shape that can be inserted into the ears, regardless of the shape of the first ear canal or the shape of the second ear canal.

The first speaker 111 outputs an acoustic signal or a voice signal received from the external device 30. The output signal is transmitted to an eardrum along the first ear canal. The first microphone 112 receives an input of a voice coming from the user's ears. In this manner, when both the first speaker 111 and the first microphone 112 are arranged within the first earphone unit 110, it is possible to prevent an external noise from being input to the first microphone 112, thereby maintaining clean call quality even in noisy environments.

Meanwhile, as illustrated in FIG. 3, an earset 10A may include a first earphone unit 110 and a second earphone unit 120. That is, the earset 10 illustrated in FIG. 2 includes only the first earphone unit 110, whereas the earset 10A illustrated in FIG. 3 further includes the second earphone unit 120.

The second earphone unit 120 is inserted into a user's second ear canal. The first earphone unit 110 includes the first speaker 111 and the first microphone 112, whereas the second earphone unit 120 may include only the second speaker 121.

Referring again to FIG. 2, the main body 100 is electrically connected to the first earphone unit 110. The main body 100 may be exposed to the outside of the user's ears. The main body 100 corrects a frequency band of a voice input to the first microphone 112 into a frequency band of a voice coming from the user's mouth, and transmits a voice signal whose frequency band is corrected to the external device 30. For this, the main body 100 may include a button unit 130, the second microphone 140, a control unit 150, and a communication unit 160.

The button unit 130 may include buttons capable of inputting commands required for operations of the earset 10. For example, the button unit 130 may include a power supply button for supplying power to the earset 10, a pairing execution button for executing a pairing operation with the external device 30, and a voice correction execution button. The voice correction execution button may activate or inactivate a voice correction function. For example, the voice correction execution button may be implemented as an ON/OFF button. Here, when the voice correction execution button is in an ON state, the voice correction function may be activated, and when the voice correction execution button is in an OFF state, the voice correction function may be inactivated.

The illustrated buttons may be implemented as separate buttons in a hardware manner or by a single button in a hardware manner. When the illustrated buttons are implemented by the single button in the hardware manner, different commands may be implemented to be input according to an operation pattern of the button. For example, a different command may be implemented to be input according to the operation pattern such as the number of times that the button is applied within a predetermined time, a time during which the button is applied, or the like. As above, the buttons provided in the button unit 130 have been described, but the illustrated buttons are not necessarily provided in the button unit 130, and obviously, the number or type of the buttons may vary depending on the case.

The second microphone 140 receives an input of a voice coming from the user's mouth. By way of an example, the second microphone 140 may always maintain an activated state. By way of another example, the second microphone 140 may be activated or inactivated according to an operation state of the button provided in the button unit 130 or a control signal received from the external device 30.

The main body 100 is exposed to the outside of the user's ears, and thereby the second microphone 140 is also exposed to the outside of the user's ears. Accordingly, the voice coming from the user's mouth is input to the second microphone 140. When the voice is input to the second microphone 140, analysis with respect to the input voice is performed, and thereby information about a frequency band is detected.

The second microphone 140 may be continuously maintained in the activated state during a call, or changed into an inactivated state. According to one embodiment, the state change of the second microphone 140 may be manually performed. By way of an example, when a user operates the button unit 130 or the external device 30, the activated state may be shifted to the inactivated state. By way of another example, the second microphone 140 may be activated and then automatically inactivated after a predetermined time.

The communication unit 160 transmits and receives signals to and from the external device 30 through the wired/wireless network 20. For example, the communication unit 160 receives an acoustic signal or a voice signal from the external device 30. When a frequency band of a voice input to the first microphone 112 is corrected into a frequency band of a voice input to the second microphone 140, the communication unit 160 transmits a voice signal whose frequency band is corrected to the external device 30. In addition, the communication unit 160 may transmit and receive a control signal required for a pairing process between the earset 10 and the external device 30. For this, the communication unit 160 may support one or more wireless communication schemes of Ultrawideband, Zigbee, Wi-Fi, and Bluetooth.

Figure 4:
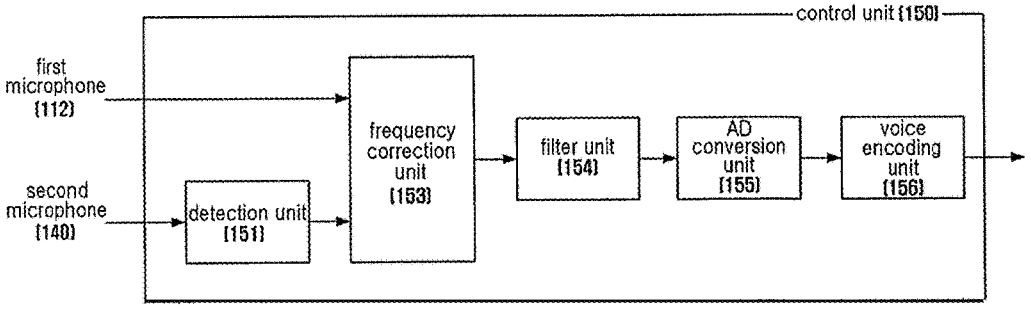
FIG. 4 illustrates a configuration of a control unit of FIGS. 2 and 3.

The control unit 150 may connect individual components of the earset 10. In addition, the control unit 150 may determine whether the voice correction function is activated, and control the individual components of the earset 10 according to the determination result. Specifically, when the voice correction function is in an activated state, the control unit 150 corrects a frequency band of a voice input to the first microphone 112 into a frequency band of a voice input to the second microphone 140. When the voice correction function is in an inactivated state, the control unit 150 respectively processes the voice input to the first microphone 112 and the voice input to the second microphone 140, and transmits the processed voices to the external device 30. For this, the control unit 150 may include a detection unit 151, a frequency correction unit 153, a filter unit 154, an AD conversion unit 155, and a voice encoding unit 156, as illustrated in FIG. 4.

The detection unit 151 may detect information about the frequency band of the voice coming from the user's mouth, from the voice input to the second microphone 140. The detected information about the frequency band may be used as a reference value for correcting the frequency band of the voice input to the first microphone 112.

The frequency correction unit 153 corrects a frequency band of a voice signal output from the first microphone 112 into a frequency band of a voice signal output from the second microphone 140. The voice signal output from the first microphone 112 is a voice signal based on the voice coming from the user's ears, and the voice signal output from the second microphone 140 is a voice signal based on the voice coming from the user's mouth, and therefore it can be understood in such a way that the frequency correction unit 153 corrects the frequency band of the voice coming from the user's ears into the frequency band of the voice coming from the user's mouth. In this instance, as the reference value used to correct the frequency band of the voice coming from the user's ears, frequency band information detected by the detection unit 151 may be used.

Here, the frequency correction unit 153 may include an equalizer that processes and adjusts overall frequency characteristics of the voice signal and maintains a range. Such a frequency correction unit 153 may be installed in a circuit within the main body 100 of the earset 10.

The filter unit 154 filters the voice signal whose frequency band is corrected and thereby removes noise. The voice signal whose noise is removed is provided to the AD conversion unit 155.

The AD conversion unit 155 converts the voice signal whose noise is removed from an analog signal to a digital signal. The voice signal converted into the digital signal is provided to the voice encoding unit 156.

The voice encoding unit 156 encodes the voice signal converted into the digital signal. The encoded voice signal may be transmitted to the external device 30 through the communication unit 160. When encoding the voice signal, the voice encoding unit 156 may use any one of a voice waveform coding scheme, a vocoding scheme, and a hybrid coding scheme.

The voice waveform coding scheme refers to a technology that transmits information about a voice waveform itself. The vocoding scheme is a scheme that extracts a characteristic parameter from a voice signal based on a generation model of the voice signal and transmits the extracted characteristic parameter to the external device 30. The hybrid coding scheme is a scheme in which the advantages of the voice waveform coding scheme and the vocoding scheme are combined, and that removes characteristics of a voice by analyzing a voice signal in the vocoding scheme and transmits an error signal in which the characteristics are removed in the waveform coding scheme. In what type of coding scheme the voice signal is encoded may be set in advance, and the set value may be implemented to be changeable by a user.

As above, the earset 10 according to an embodiment and the earset 10A according to the other embodiment have been described with reference to FIGS. 2 to 4. In FIGS. 2 to 4, a case in which an operation of detecting information about the frequency band of the voice input to the second microphone 140 and an operation of correcting the frequency band of the voice input to the first microphone 112 are performed in the earset 10 or 10A depending on whether the voice correction function is activated has been described. However, these operations are not necessarily performed in the earset 10 or 10A.

According to still another embodiment, the operation of correcting the frequency band of the voice input to the first microphone 112 may be performed in the external device 30, regardless of whether the voice correction function is activated. Hereinafter, an earset 10B according to still another embodiment of the present invention will be described with reference to FIGS. 5 and 6.

Figure 5:
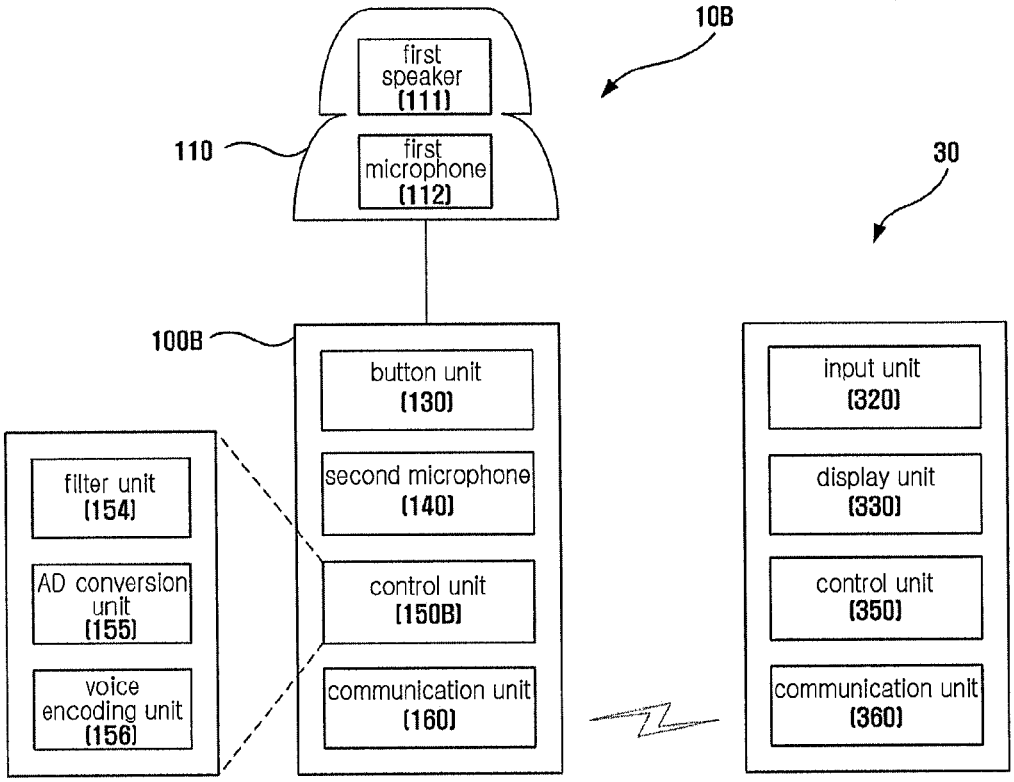
FIG. 5 illustrates a configuration of an earset according to still another embodiment of the present invention and an external device.
Figure 6:
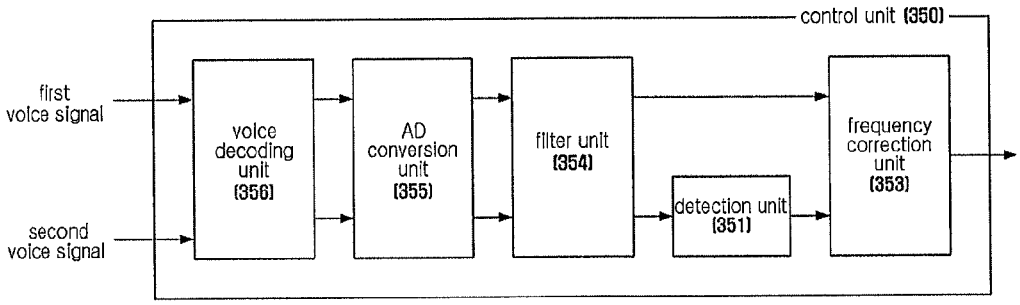
FIG. 6 illustrates a configuration of a control unit of FIG. 5.

FIG. 5 illustrates a configuration of the earset 10B according to still another embodiment of the present invention and the external device 30, and FIG. 6 illustrates a configuration of a control unit 350 of the external device 30 illustrated in FIG. 5.

The first speaker 111, the first microphone 112, the button unit 130, the second microphone 140, and the communication unit 160 which are illustrated in FIG. 5 are similar to or identical to the first speaker 111, the first microphone 112, the button unit 130, the second microphone 140, and the communication unit 160 which are illustrated in FIGS. 2 and 3, and thus repeated description thereof will be omitted, and differences therebetween will be mainly described.

The control unit 150 of the earset 10 illustrated in FIGS. 2 and 3 includes the detection unit 151, the frequency correction unit 153, the filter unit 154, the AD conversion unit 155, and the voice encoding unit 156, whereas a control unit 150B of the earset 10B illustrated in FIG. 5 includes only a filter unit 154, an AD conversion unit 155, and a voice encoding unit 156. When the control unit 150B of the earset 10B is configured as illustrated in FIG. 5, the control unit 150B may respectively process a voice input to the first microphone 112 and a voice input to the second microphone 140, and respectively transmit voice signals obtained as the processing results to the external device 30. That is, the filter unit 154 of the control unit 150B respectively filters a voice signal (hereinafter, referred to as a "first voice signal") output from the first microphone 112 and a voice signal (hereinafter, referred to as a "second voice signal") output from the second microphone 140 to remove noise, the AD conversion unit 155 respectively converts the filtered first and second voice signals from analog signals to digital signals, and the voice encoding unit 156 respectively encodes the first and second voice signals converted into the digital signals.

Referring to FIG. 5, the external device 30 may include an input unit 320, a display unit 330, a control unit 350, and a communication unit 360.

The input unit 320 may include one or more keys as a portion of receiving an input of a command from a user.

The display unit 330 is a portion that displays a command processing result, and may be implemented as a flat panel display or a flexible display. The display unit 330 may be implemented separately from the input unit 320 in a hardware manner, or implemented in the form that the display unit 330 is integrated with the input unit 320, such as a touch screen.

The communication unit 360 transmits and receives signals and/or data to and from the communication unit 160 of the earset 10B. For example, the communication unit 360 may receive the first and second voice signals transmitted from the earset 10B.

The control unit 350 corrects a frequency band of the first voice signal into a frequency band of the second voice signal. For this, the control unit 350 may include a voice decoding unit 356, an AD conversion unit 355, a filter unit 354, a detection unit 351, and a frequency correction unit 353, as illustrated in FIG. 6.

The voice decoding unit 356 respectively decodes the first and second voice signals received from the earset 10B. The decoded first and second voice signals are provided to the AD conversion unit 355.

The AD conversion unit 355 respectively converts the decoded first and second voice signals into digital signals. The first and second voice signals converted into the digital signals are provided to the filter unit 354.

The filter unit 354 respectively filters the first and second voice signals converted into the digital signals to remove noise. The first voice signal from which noise is removed is provided to the frequency correction unit 353, and the second voice signal from which noise is removed is provided to the detection unit 351.

The detection unit 351 detects information about a frequency band of the corresponding signal from the second voice signal from which noise is removed. The detected information about the frequency band may be used as a reference value for correcting the frequency band of the first voice signal.

The frequency correction unit 353 corrects the first voice signal from which noise is removed, using the information about the frequency band detected by the detection unit 351. Here, the frequency correction unit 353 may include an equalizer that processes and adjusts overall frequency characteristics of the voice signal and maintains a range.

As above, the control unit 350 of the external device 30 has been described with reference to FIG. 6. According to one embodiment, at least one of components of the control unit 350 may be implemented in a hardware manner. According to another embodiment, the at least one of the components of the control unit 350 may be implemented in a software manner. That is, the at least one of the components of the control unit 350 may be implemented by a voice correction program or a voice correction application. In this case, the voice correction program or the voice correction application may be provided from a manufacturer of the earset 10B, or provided from other external devices (not illustrated) through the wired/wireless network 20.

Figure 7:
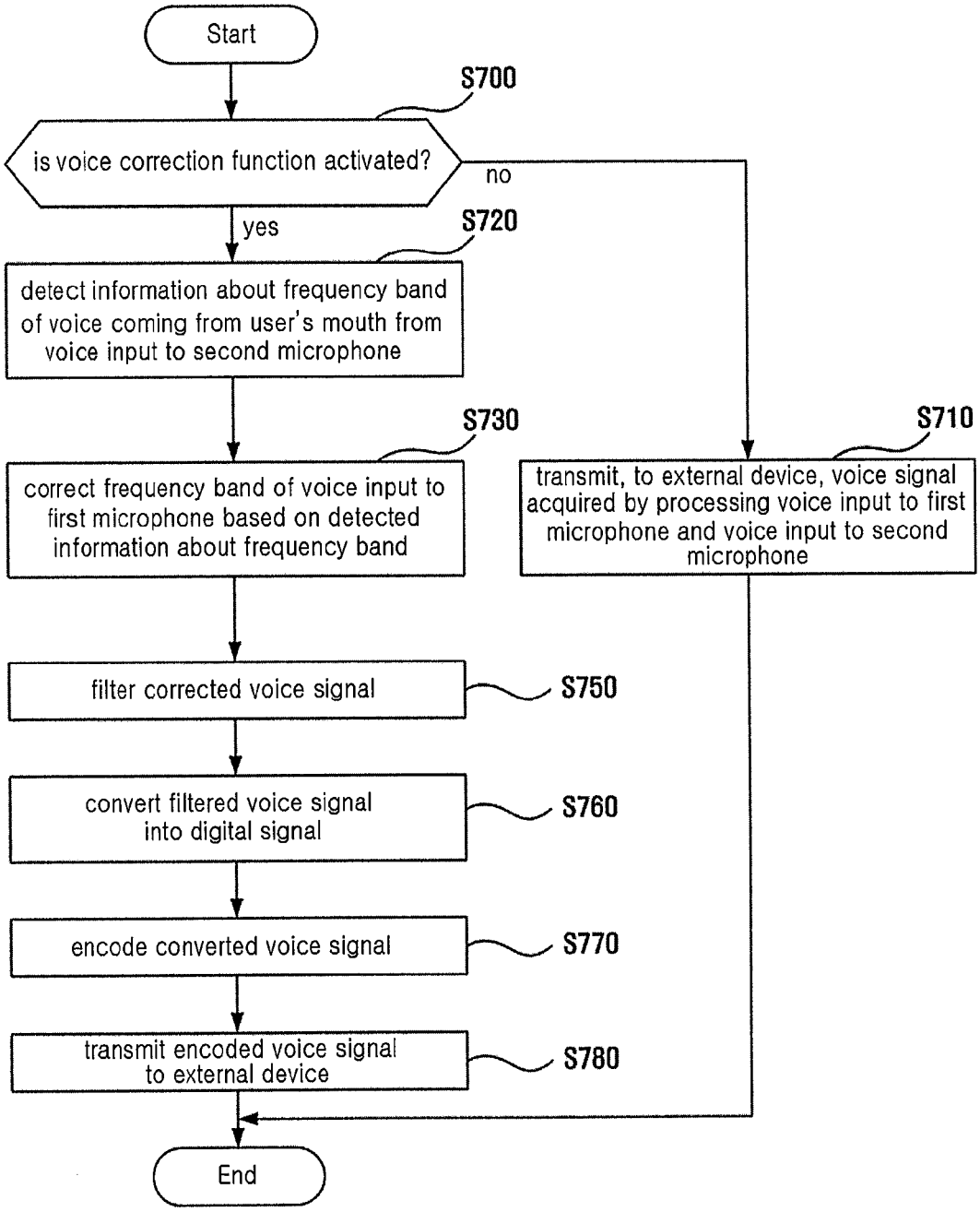
FIG. 7 is a flowchart illustrating a control method for an earset illustrated in FIGS. 2 to 6.

FIG. 7 is a flowchart illustrating a control method for the earset 10, 10A, or 10B illustrated in FIGS. 2 to 6.

Prior to description, when the earset 10, 10A, or 10B and the external device 30 communicate with each other according to a wireless communication scheme, it is assumed that a pairing process between the earset 10, 10A, or 10B and the external device 30 has been completed. In addition, it is assumed that the earset 10, 10A, or 10B is worn on a user's ears.

First, in operation S700, whether a voice correction function is activated is determined. Whether the voice correction function is activated may be determined based on the operation state of the voice correction execution button provided in the button unit 130 or the presence/absence of the control signal received from the external device 30.

When the voice correction function is not activated (NO in operation S700) based on the determination result of operation S700, a voice input to the first microphone 112 and a voice input to the second microphone 140 are processed by the control unit 150, and the processed voice signals are transmitted to the external device 30 in operation S710. Operation S710 may include an operation of filtering a first voice signal output from the first microphone 112 and a second voice signal output from the second microphone 140, an operation of converting the filtered first and second voice signals into digital signals, an operation of encoding the converted first and second voice signals, and an operation of transmitting the encoded first and second voice signals to the external device 30.

When the voice correction function is activated (YES in operation S700) based on the determination result of operation S700, information about a frequency band of a voice coming from the user's mouth is detected from the voice input to the second microphone 140 in operation S720. Operation S720 may be performed by the detection unit 151 of the control unit 150.

Next, in operation S730, the frequency band of the voice input to the first microphone 112 is corrected based on the detected information about the frequency band. That is, the frequency band of the voice coming from the user's ears is corrected into the frequency band of the voice coming from the user's mouth. Operation S730 may be performed by the frequency correction unit 153 of the control unit 150.

In operation S750, the voice signal whose frequency band is corrected is filtered by the filter unit 154 so that noise is removed, and in operation S760, the filtered voice signal is converted from an analog signal to a digital signal by the AD conversion unit 155. The voice signal converted into the digital signal is encoded by the voice encoding unit 156 in operation S770, and the encoded signal is transmitted to the external device 30 through the communication unit 160 in operation S780. In this manner, when the frequency band of the voice coming from the user's ears is corrected into the frequency band of the voice coming from the user's mouth, it is possible to improve the call quality.

Meanwhile, although not illustrated in FIG. 7, the control method for the earset 10, 10A, or 10B may further include an operation of inactivating the second microphone 140. The operation of inactivating the second microphone 140 may be performed after, for example, operation S720.

In addition, in FIG. 7, a case in which whether the voice correction function is activated is determined in operation S700, the voice signal is corrected in the earset 10, 10A, or 10B based on the determination result in operations S720 to S780, and the voice signal is transmitted to the external device 30 in operation S710, so that the voice is corrected in the external device 30 has been described. However, operation S700 of determining whether the voice correction function is activated is not necessarily performed. For example, in a case in which the voice correction execution button is not provided in the button unit 130, operations S700 and S710 may be omitted in FIG. 7.

As above, with reference to FIGS. 2 to 7, the earsets 10, 10A, and 10B including the first microphone 112 and the second microphone 140 and the control method for the same have been described. Hereinafter, an earset including only the first microphone 112 and a control method for the same will be described with reference to FIGS. 8 to 10.

Figure 8:
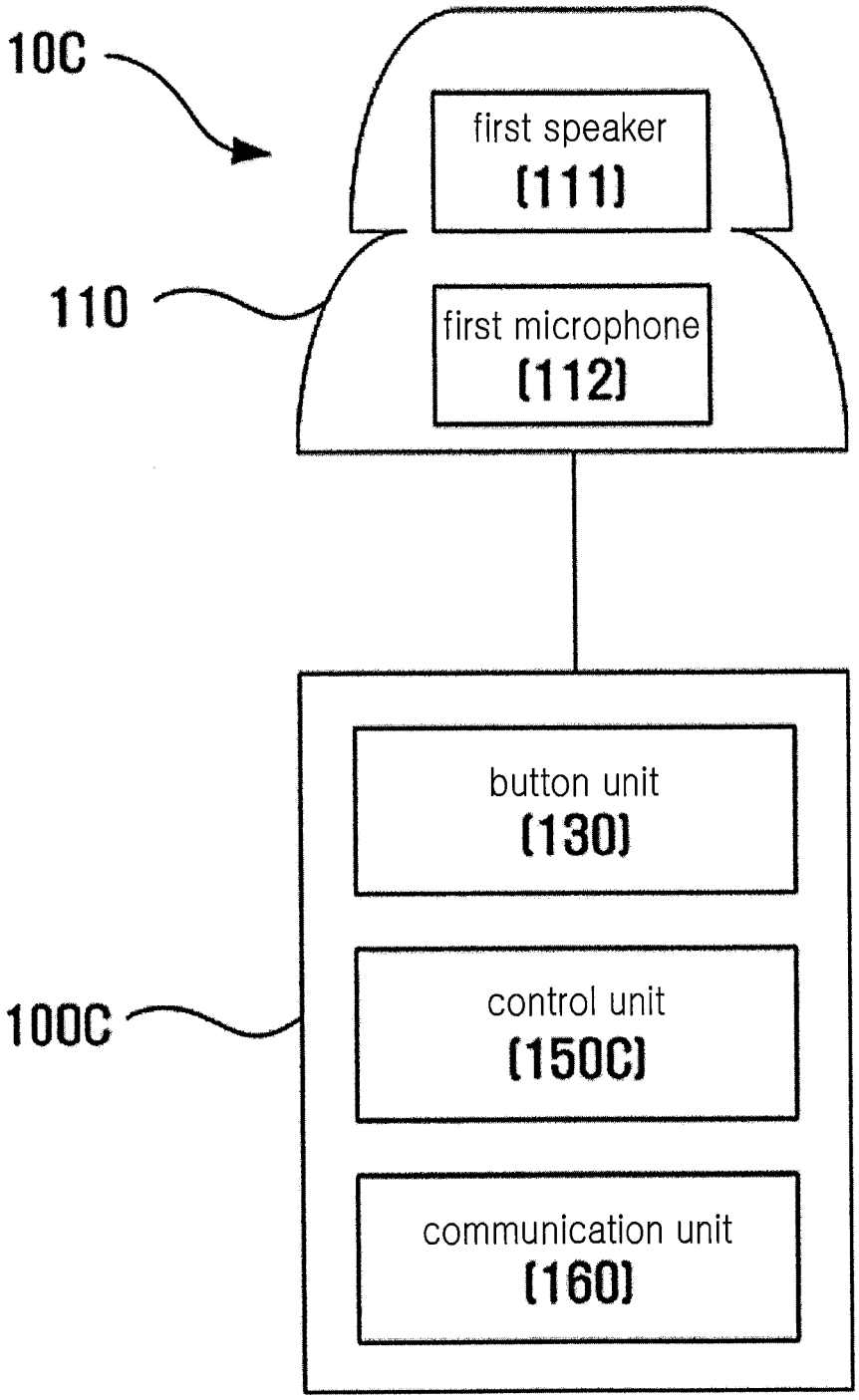
FIG. 8 illustrates a configuration of an earset according to yet another embodiment of the present invention.

FIG. 8 illustrates a configuration of an earset according to yet another embodiment of the present invention.

Referring to FIG. 8, an earset 10C may include the first earphone unit 110 and a main body 100C.

The first earphone unit 110 is a portion that is inserted into a user's first ear canal (an ear canal of the left ear) or the user's second ear canal (an ear canal of the right ear), and includes the first speaker 111 and the first microphone 112. The first microphone 112 receives an input of a voice coming from the user's ears. Although not illustrated in FIG. 8, the earset 10C may further include a second earphone unit. Only a second speaker (not illustrated) may be disposed in the second earphone unit.

The main body 100C is electrically connected to the first earphone unit 110. The main body 100C includes the button unit 130, a control unit 150C, and the communication unit 160. The button unit 130 and the communication unit 160 of FIG. 8 are similar to or identical to the button unit 130 and the communication unit 160 of FIG. 2, and thus repeated description thereof will be omitted, and the control unit 150C will be mainly described.

When a voice correction execution function is activated, the control unit 150C corrects a frequency band of a voice input to the first microphone 112 into a frequency band (hereinafter, referred to as a "reference frequency band") of a voice coming from a user's mouth, and transmits the corrected frequency band to the external device 30. When the voice correction execution function is inactivated, the control unit 150C processes the voice input to the first microphone 112 and transmits the processed voice to the external device 30. For this, the control unit 150C may include a frequency correction unit 153C, the filter unit 154, the AD conversion unit 155, and the voice encoding unit 156, as illustrated in FIG. 9.

Figure 9:
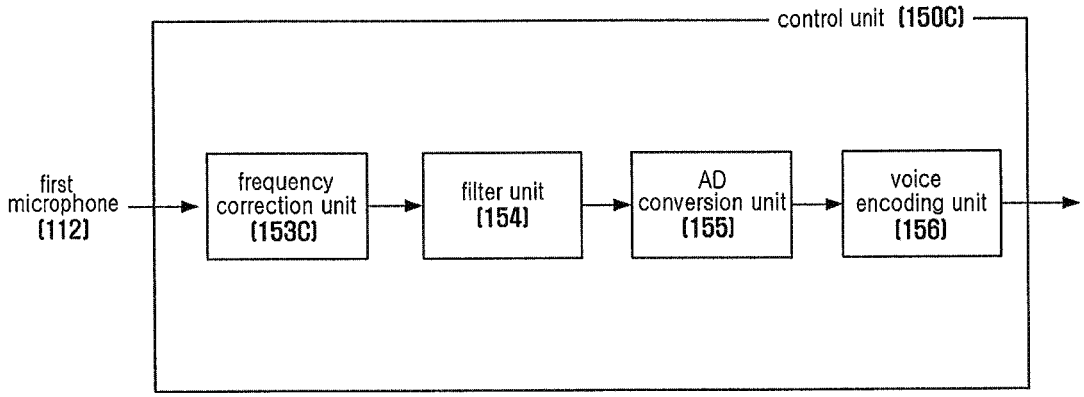
FIG. 9 illustrates a configuration of a control unit of FIG. 8.

Referring to FIG. 9, the frequency correction unit 153C corrects a frequency band of a voice signal output from the first microphone 112 into a reference frequency band. Information about the reference frequency band may be experimentally obtained in advance, and stored in the frequency correction unit 153C. Specifically, by collecting and analyzing voices of 100 females, information about a reference frequency band (hereinafter, referred to as a "first reference frequency band") regarding the female's voice may be obtained. In addition, by collecting and analyzing voices of 100 males, information about a reference frequency band (hereinafter, referred to as a "second reference frequency band") regarding the male's voice may be obtained.

The information about the first reference frequency band and the information about the second reference frequency band may be stored in the frequency correction unit 153C. The stored information may be implemented to be updated by communication with the external device 30.

According to an embodiment, the frequency correction unit 153C may determine the voice gender of a voice signal output from the first microphone 112. When the voice signal output from the first microphone 112 is a female's voice signal based on the determination result, the frequency correction unit 153C corrects the frequency band of the voice signal output from the first microphone 112 into the first reference frequency band. When the voice signal output from the first microphone 112 is a male's voice signal, the frequency correction unit 153C corrects the frequency band of the voice signal output from the first microphone 112 into the second reference frequency band.

By way of another example, the frequency correction unit 153C may include a frequency estimation program. The frequency estimation program is a program that estimates a frequency band of a voice coming from a user's mouth according to a frequency of the user's voice signal of a low frequency band received through the first microphone 112. Thus, the frequency correction unit 153C may analyze the frequency band of the user's voice signal received through the first microphone 112, estimate the frequency band of the voice coming from the user's mouth through the frequency estimation program, and thereby manually or automatically correct the corresponding frequency band.

The filter unit 154 filters the voice signal whose frequency band is corrected to remove noise, the AD conversion unit 155 converts the voice signal from which noise is removed from an analog signal to a digital signal, and the voice encoding unit 156 encodes the voice signal converted into the digital signal.

Figure 10:
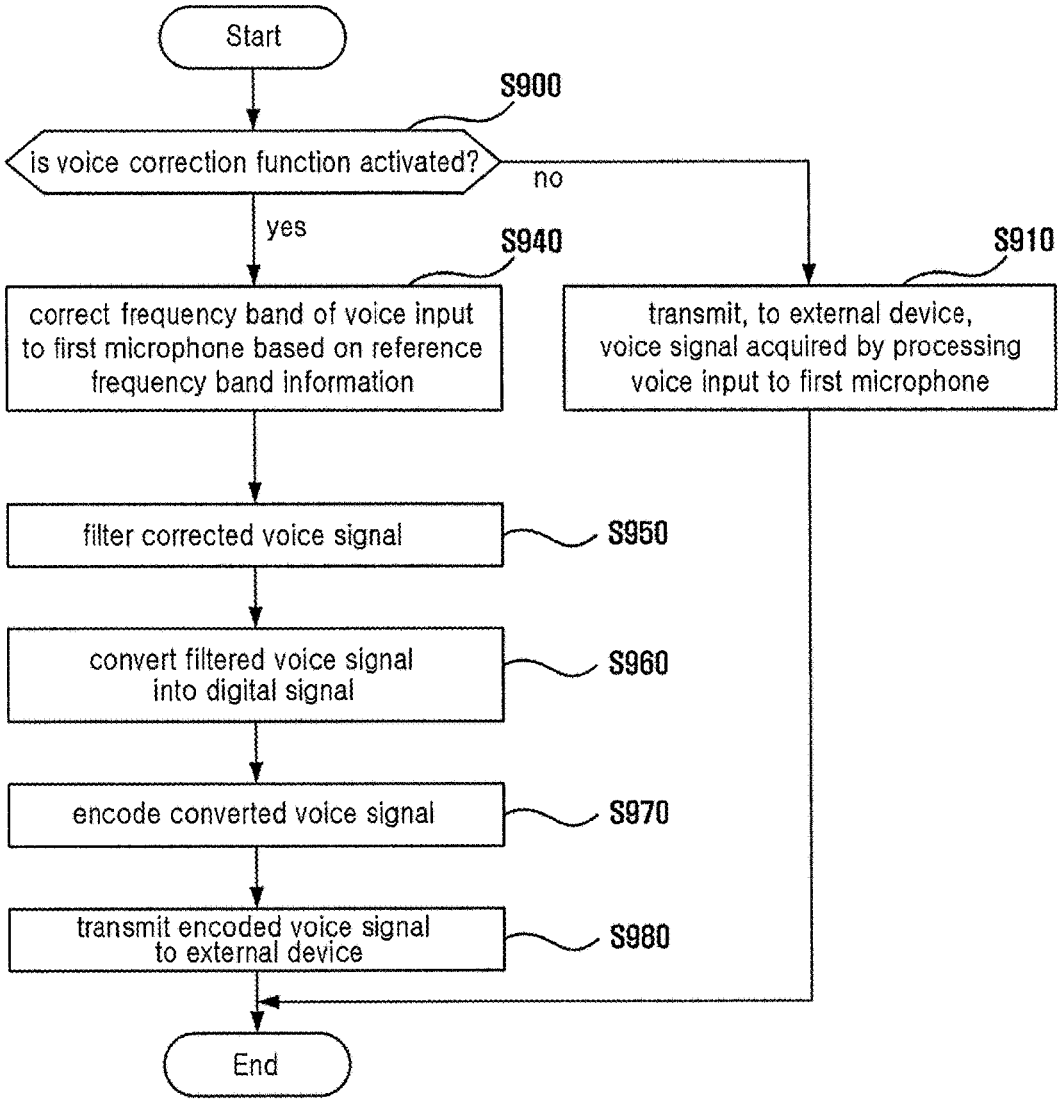
FIG. 10 is a flowchart illustrating a control method for an earset illustrated in FIGS. 8 and 9.

FIG. 10 is a flowchart illustrating a control method for the earset 10C illustrated in FIGS. 8 and 9.

Prior to description, when the earset 10C and the external device 30 communicate with each other according to a wireless communication scheme, it is assumed that a pairing process between the earset 10C and the external device 30 has been completed. In addition, it is assumed that the earset 10C is worn on a user's ears.

First, in operation S900, whether a voice correction function is activated is determined. Whether the voice correction function is activated may be determined based on the operation state of the voice correction execution button provided in the button unit 130 or the presence/absence of the control signal received from the external device 30.

When the voice correction function is not activated (NO in operation S900) based on the determination result of operation S900, a voice input to the first microphone 112 and a voice input to the second microphone 140 are processed by the control unit 150C, and the processed voice signals are transmitted to the external device 30 in operation S910. Operation S910 may include an operation of filtering a voice signal output from the first microphone 112, an operation of converting the filtered voice signal into a digital signal, an operation of encoding the converted voice signal, and an operation of transmitting the encoded voice signal to the external device 30.

When the voice correction function is activated (YES in operation S900) based on the determination result of operation S900, a frequency band of the voice input to the first microphone 112 is corrected based on reference frequency band information stored in advance in operation S940. According to an embodiment, operation S940 may include an operation of correcting the frequency band of the input voice into the first reference frequency band when the voice input to the first microphone 112 is a female's voice, and an operation of correcting the frequency band of the input voice into the second reference frequency band when the voice input to the first microphone 112 is a male's voice.

In operation S950, the voice signal whose frequency band is corrected is filtered by the filter unit 154 so that noise is removed, and in operation S960, the filtered voice signal is converted from an analog signal to a digital signal by the AD conversion unit 155. The voice signal converted into the digital signal is encoded by the voice encoding unit 156 in operation S970, and the encoded signal is transmitted to the external device 30 through the communication unit 160 in operation S980. In this manner, when the frequency band of the voice coming from the user's ears is corrected into the reference frequency band, it is possible to obtain similar effects to those obtained by correcting the frequency band of the voice coming from the user's ears into the frequency band of the voice coming from the user's mouth, thereby improving the call quality.

Meanwhile, in FIG. 10, a case in which whether the voice correction function is activated is determined in operation S900, the voice signal is corrected in the earset 10C based on the determination result in operations S940 to S980, and the voice signal is transmitted to the external device 30 in operation S910, so that the voice is corrected in the external device 30 has been described. However, operation S900 of determining whether the voice correction function is activated is not necessarily performed. For example, in a case in which the voice correction execution button is not provided in the button unit 130, operations S900 and S910 may be omitted in FIG. 10.

Although not illustrated, the earset according to an embodiment of the present invention may further include a volume adjustment unit that adjusts a volume and a call button unit that determines whether to make a call.

In addition, the earset according to an embodiment of the present invention may further include a mode setting means that allows a call through the voice coming from the user's ears or the voice coming from the user's mouth.

In addition, the earset according to an embodiment of the present invention may process the voice signal transmitted from the user's ears, that is, the voice signal input to the first microphone 112 and the voice signal transmitted from the user's mouth, that is, the voice signal input to the second microphone 140 into digital signals, and then transmit the processed signals to the external device 30. In this instance, the external device 30 may restore the voice signal received from the first microphone 112 and the voice signal received from the second microphone 140 using an app or software installed in advance, set the voice signal received from the first microphone 112 as a reference signal, and remove noise from the voice signal received from the second microphone 140. Thus, it is possible to increase the voice recognition efficiency.

As described above, according to the embodiments of the present invention, the frequency band of the voice coming from the user's ears may be corrected into the frequency band of the voice coming from the user's mouth, thereby improving the call quality.

The methods according to various embodiments of the present invention may be implemented in the form of software readable by various computer means and recorded in a computer-readable recording medium. The computer-readable recording medium may separately include program commands, local data files, local data structures, etc. or include a combination of them. The medium may be specially designed and configured for the present invention, or known and available to those of ordinary skill in the field of computer software. Examples of the computer-readable recording medium include magnetic media, such as a hard disk, a floppy disk, and a magnetic tape, optical media, such as a CD-ROM and a DVD, magneto-optical media such as a floptical disk, and hardware devices, such as a ROM, a RAM, and a flash memory, specially configured to store and perform program commands. The recording medium may be implemented in the form of a carrier wave such as Internet transmission. Also, the computer-readable recording medium can also be distributed throughout a computer system connected over a computer communication network so that the computer-readable codes may be stored and executed in a distributed fashion. Examples of the program commands may include high-level language codes executable by a computer using an interpreter, etc. as well as machine language codes made by compilers.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A control method for an earset including a first earphone unit that is inserted into ears of a user while including a first microphone and a first speaker, and a main body that is connected to the first earphone unit, the control method comprising the steps of:

determining whether a voice correction function is activated;

determining a voice gender of the voice coming from the inside of ears of the user and input to the first microphone, when the voice correction function is activated; and correcting a frequency band of the voice input to the first microphone into a reference frequency band that is a frequency band of a voice coming from a mouth, based on the determination result.

2. The control method of claim 1, wherein the reference frequency band comprises at least one of a first reference frequency band and a second reference frequency band, wherein the first reference frequency band is obtained by collecting and analyzing voices of females, and wherein the second reference frequency band is obtained by collecting and analyzing voices of males.

3. The control method of claim 1, wherein the correcting of the frequency band of the voice is performed in a control unit provided in the main body or performed in a control unit provided in an external device capable of communicate with the main body.

4. The control method of claim 1, wherein a second microphone for receiving an input of the voice coming from a mouth of the user is disposed in the main body, and wherein the second microphone is activated or inactivated based on a control signal received from a button unit provided in the main body or an external device.

5. The control method of claim 4, when the voice coming from the inside of ears of the user is input to the first microphone during activation of the voice correction function or the second microphone, further comprising correcting the frequency band of the voice input to the first microphone into a frequency band of the voice input to the second microphone.

6. The control method of claim 4, wherein the second microphone is inactivated after the voice coming from the mouth of the user is input.

7. An earset system comprising:

an earset that includes a first earphone unit inserted into ears of a user while including a first microphone and a first speaker, and a main body connected to the first earphone unit; and a control unit that corrects, when a voice coming from the ears of the user is input to the first microphone, a frequency band of the voice input to the first microphone into a reference frequency band that is a frequency band of a voice coming from a mouth, based on a result obtained by determining a voice gender of the voice input to the first microphone.

8. The earset system of claim 7, wherein a second microphone for receiving an input of the voice coming from the mouth of the user is disposed in the main body, and the control unit detects information about the reference frequency band from a voice input to the second microphone.

9. The earset system of claim 7, wherein the reference frequency band comprises at least one of a first reference frequency band and a second reference frequency band, wherein the first reference frequency band is obtained by collecting and analyzing voices of females, and wherein the second reference frequency band is obtained by collecting and analyzing voices of males.

10. The earset system of claim 7, wherein the control unit is disposed in the main body or disposed in an external device capable of communicating with the main body.

* * * * *